United States Patent [19]

Becker et al.

[11] 4,180,219

[45] Dec. 25, 1979

[54] LAP CREEL COMPRISING ROD SHAPED CARRIER ELEMENTS

[76] Inventors: Josef Becker; Hubert Becker; Matthias Becker, all of Niederforstbacher Str. 80-84, 5100 Aachen-Brand, Fed. Rep. of Germany

[21] Appl. No.: 920,546

[22] Filed: Jun. 29, 1978

[30] Foreign Application Priority Data

Jul. 8, 1977 [DE] Fed. Rep. of Germany ..... 2730876

[51] Int. Cl.[2] ..... B65H 75/20; B65H 75/28

[52] U.S. Cl. ..... 242/118.1; 242/118.3

[58] Field of Search ..... 242/118.1, 118.11, 118.3, 242/118.31, 118.32; 118; 68/198, 189

[56] References Cited

U.S. PATENT DOCUMENTS

| | | | |
|---|---|---|---|
| 3,138,345 | 6/1964 | Luber | 242/118.1 |
| 3,232,082 | 2/1966 | Fallscheer | 242/118.1 |
| 3,960,341 | 6/1976 | Thelen | 242/118.1 |
| 4,078,740 | 3/1978 | Hahm et al. | 242/118.1 |

FOREIGN PATENT DOCUMENTS

| | | | |
|---|---|---|---|
| 1115209 | 12/1955 | France | 242/118.1 |

*Primary Examiner*—George F. Mautz

*Attorney, Agent, or Firm*—W. G. Fasse; D. F. Gould

[57] ABSTRACT

A lap creel comprising rod shaped carrier elements is used, for example, in the textile industry for winding up textile threads or yarns. For this purpose the rod shaped carrier elements are held together by holding or fixing elements which together with the carrier elements form a circular cage from which the carrier elements protrude radially beyond the holding elements. A plurality of holding elements may be arranged along the lap creel. The individual rod shaped carrier elements have a tapering shape so that the lap creel itself has a conical shape with a largest diameter end and a smallest diameter end. At the largest diameter end the holding element encircles the carrier elements so that the latter face radially inwardly. At the smallest diameter end, the carrier element surrounds the holding element so that the carrier elements face radially outwardly in the form of ribs.

6 Claims, 3 Drawing Figures

FIG.1
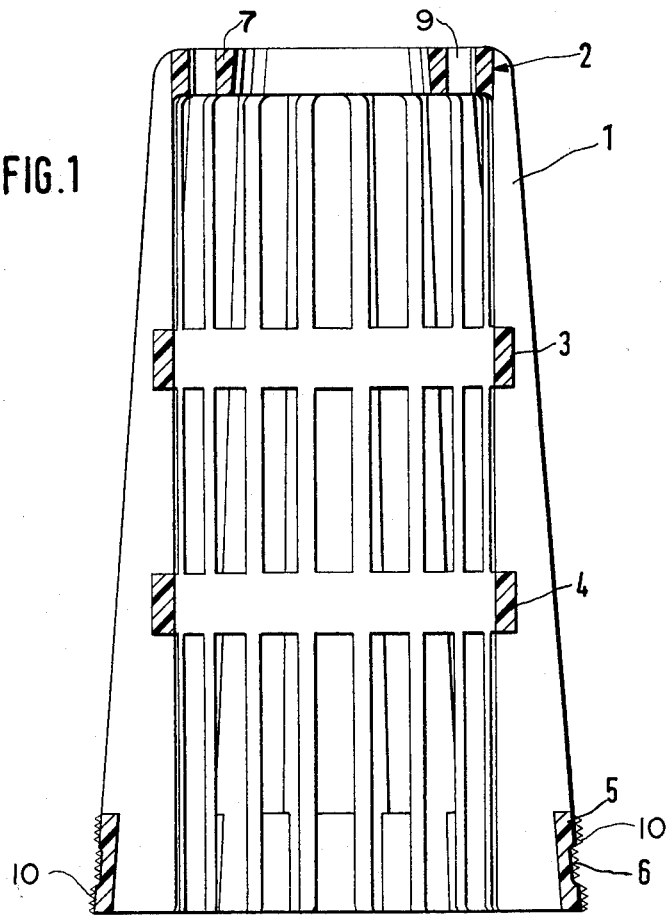
FIG.3
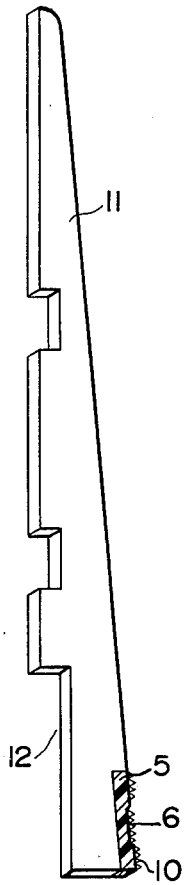
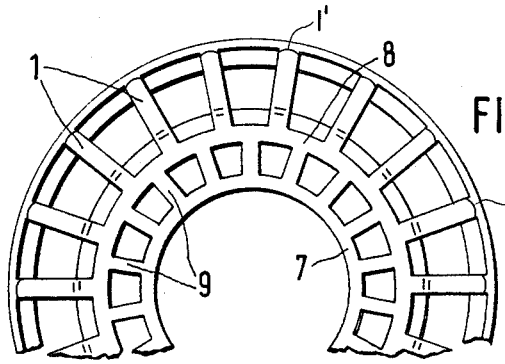
FIG.2

LAP CREEL COMPRISING ROD SHAPED CARRIER ELEMENTS

BACKGROUND OF THE INVENTION:

The present invention relates to lap creels comprising rod shaped carrier elements which together with ring shaped fixing or holding elements form a circular cage. The carrier elements protrude radially beyond the holding elements.

For taking up a thread type textile material, different types of lap creels are known in the art which are constructed of rod shaped carrier elements. These carrier elements extend in parallel to the central axis of the lap creel. The carrier elements extend radially outwardly to a common cylinder surface and are connected only to one so-called end ring.

In one particular embodiment of such a prior art lap creel the end ring comprises perforations which are substantially adapted to the cross section of the carrier elements. The number of the perforations corresponds to the number of the carrier elements so that the lap creels may be nested one within another in a coaxial fashion. In addition to the end ring there are arranged so-called support rings which are distributed along the height or length of the carrier elements, whereby neighboring lap creels may be nested within each other only to a limited extent. The nesting is limited because the ends of the carrier elements of one lap creel positioned opposite the end ring, butt against the support ring located closest to the end ring of the other lap creel.

However, this type of arrangement has the advantage that the lap creels nested within each other require less space while being transported and during storage. An additional advantage is seen in that these lap creels permit a uniform densification of the thread type textile goods because the measure or extent by which one lap creel may be pushed into a neighboring lap creel is definitely limited. However, the disadvantage is seen in that this type of structure does not have a sufficient inherent stiffness unless the lap creel is manufactured of a high strength material. The stiffness cannot be increased by using more support rings since the number of such rings must be limited in favor of avoiding the hindrance of the flow of treatment media as much as possible. Thus, the increasing of the number of support rings for improving the inherent stiffness is subject to limitation. An even more important disadvantage of the known construction is seen in that it is not possible to form a freely accessible thread reserve on the lap creel. Such a thread reserve or supply is used to connect ahead of time, the end of the thread of one winding with the beginning of the thread of another winding. A thread supply cannot be formed at one end of the prior art lap creel because the end ring with its perforations is in the way. A thread reserve applied at the opposite end would slide off without any hindrance even if the ends of the carrier elements would not be rounded off.

OBJECTS OF THE INVENTION

In view of the above it is the aim of the invention to achieve the following objects singly or in combination:

to construct a lap creel in such a manner that it may be inserted coaxially into another lap creel of the same construction to a definite proportion of its height or length;

to construct a lap creel in such a manner that a sufficient inherent stiffness will be accomplished without using high strength materials;

to construct the lap creel in such a manner that a freely accessible thread reserve may be formed on the lap creel and that such a thread reserve is prevented from an unintended shifting or displacement;

to avoid the use of a radially outwardly extending end ring;

to avoid any hindrance of the densification of a thread winding or coil located on the lap creel according to the invention;

to construct the lap creel in such a manner that it may be used on standardized automatic coiling or winding machines without any difficulties;

to assure a homogeneous flow of the thread treatment media through the lap creel along its entire height or length; and to assure a gentle uncoiling of the textile goods, whereby, for example, a contact of the thread at the end of the de-coiling with the upper inner ends of the carrier elements is avoided.

SUMMARY OF THE INVENTION

According to the invention there is provided a lap creel comprising rod shaped carrier elements and holding means for said carrier elements to form with the carrier elements a circular cage such, that the outer longitudinal edges of the carrier elements form an acute angle relative to the central axis of the lap creel. In the area of the largest lap creel outer diameter the carrier elements protrude radially inwardly whereas in the area of the smallest lap creel outer diameter, the carrier elements protrude radially outwardly relative to the holding means or elements.

The construction of the invention results in a lap creel having an especially large inherent stiffness because the effectiveness of the holding elements is distributed over the cross section of the carrier elements without the need for an end ring which would protrude radially outwardly beyond the carrier elements. Thus, the lap creel according to the invention provides a free winding surface extending from one end of the lap creel to the other end thereof. Accordingly, it is possible to form a freely accessible thread reserve or supply especially on the end with the larger outer diameter. This thread reserve cannot slide off the lap creel due to its conical shape. Surprisingly, a hindrance of the densification of a thread lap located on the lap creel according to the invention, does not occur although the lap densifies exclusively from the end of the lap creel having the smaller diameter in the direction to the end having the larger diameter. Actually, the conical shape of the lap creel according to the invention does not hinder the densification process because the diminishing slanted course of the lap layers which cross each other, causes a diameter increase.

BRIEF FIGURE DESCRIPTION

In order that the invention may be clearly understood, it will now be described, by way of example, with reference to the accompanying drawings, wherein:

FIG. 1 illustrates a vertical section through the lap creel according to the invention;

FIG. 2 is a partial view in the direction of the arrow A in FIG. 1 onto the top of the lap creel and FIG. 3 shows a carrier element for the present lap creel with a cut-out at one end of the carrier element.

DETAILED DESCRIPTION OF PREFERRED EXAMPLE EMBODIMENTS:

As shown in FIG. 1, the lap creel according to the invention comprises a plurality of rod shaped carrier elements 1 having a trapezoidal form and a conical cross section, whereby the cross sectional thickness diminishes radially outwardly as shown in FIG. 2. In the area of the upper end of the lap creel, which is the smallest diameter end thereof, the radially outwardly directed edges of the carrier elements 1 may be bowshaped relative to the central longitudinal axis of the lap creel, whereby the upper end of the carrier elements is somewhat truncated. The carrier elements 1 are held in position by means of ring shaped holding or fixing elements 2, 3, 4, and 5 so that a cage of circular cross section is formed. The carrier elements 1 form ribs, the outer edges of which are rounded as shown at 1' in FIG. 2. As mentioned, the ribs or carrier elements 1 have a slight taper in the radially outward direction. Each carrier element has a long cross-sectional axis extending radially and a short cross-sectional axis extending perpendicularly to said long cross-sectional axis.

As best seen in FIG. 1, the carrier elements 1 protrude radially outwardly beyond the holding elements 2, 3, and 4. However, the holding element 5 at the larger diameter end of the lap creel is so constructed and arranged that the carrier elements 1 extend radially inwardly from the holding element 5. The holding elements 3 and 4 are of identical construction. The holding element 2 at the smallest diameter end of the lap creel, has an outer diameter which is equal to or smaller than the inner diameter of the holding element 3 and 4. Due to this feature and due to the further feature that the free spaces between adjacent carrier elements 1 are equal to or larger in size than the cross sectional width of the carrier elements 1, it is possible, according to the invention to push lap creels coaxially one into the other to such an extent until the lower ends of the carrier elements 1 of one lap creel abut against the holding ring 3 of another lap creel. The inner diameter of the holding ring 5 is selected, in this connection, in such a manner that it will not cause any jamming or sticking of the lap creels nested one within the other.

For forming a thread reserve or supply, the holding ring 5 at the lower or largest diameter end of the lap creel is provided with a roughened surface 10 and with a ring groove 6.

In order to increase the inherent stiffness of the present lap creels, the holding element 2 comprises an inner ring 7 and an outer ring 8 which are arranged coaxially relative to each other and which are interconnected by radially extending lands 9 as shown in FIG. 2.

The described construction of the carrier elements 1 according to the invention results in an excellent inherent stiffness of each individual carrier element and the particular configuration of the cross section of the carrier elements with a radially outwardly extending taper facilitates the flow of the thread treatment media such as dyes or the like.

The above mentioned bow-shape of the radially outwardly directed edges of the carrier elements in the zone of the upper end of the lap creel toward the central axis of the lap creel assures a gentle reeling off operation of the textile goods. In this manner it is prevented that especially toward the end of the reeling off operation the thread contacts the upper end of the carrier elements 1.

As shown in FIG. 1 the lower holding ring 5 forms the jacket of a frustum adjacent to the largest outer diameter of the lap creel. The outer surface of the frustum is roughened as shown at 10 and provided with a ring groove 6. The frustum shape of the lower end of the holding ring 5 permits the use of the lap creels according to the invention on standardized automatic winding machines without any difficulties. The roughened surface 10 and ring groove 6 on the other hand, provide a gripping type winding surface which facilitates the initial starting of a winding and which also prevents an unintended shifting of the first layer of a winding.

It may be advantageous for starting the initial winding operation, to extend the frustum jacket from the lower end of the lap creel over about one third of the length of the carrier elements 1. In addition it is advantageous to provide such extended frustum jacket with perforations which may be dimensioned in such a manner, without impairing the stability of the lap creel, that a homogeneous flow of the treatment media is assured throughout the entire height or length of the lap creel.

In order to limit the penetration depth of one lap creel nested into a neighboring lap creel, the invention suggests that a holding ring is arranged at a location spaced about one third of the length of the carrier elements 1 from the upper end of the lap creel. Such a holding element has an outer diameter larger than any other holding element located in said one third length of the lap creel. Due to this arrangement of a holding element with a larger outer diameter, according to the invention it is possible that the lower ends of the carrier elements 1 of a lap creel may advance without any hindrance until they abut against the holding elements having the increased diameter in a lap creel under the respective carrier elements. Stated differently, the inner edge of the carrier elements of an outer lap creel come to rest on the holding elements having the increased diameter in a lap creel nested inside the outer lap creel.

An especially advantageous embodiment of the invention uses carrier elements 11 shown in FIG. 3 which are provided with radially inwardly facing steps forming cut-outs 12 located within the frustum jacket. These cut-outs 12 provide a free space inside the lap creel. Depending on the steps the free space has a number of inner diameters which are larger than the outer diameters of the holding elements which are arranged in the upper one third length of the carrier element. By this type of structure it is possible to make the carrier elements relatively broad where they extend outside of the frustum jacket, yet such broad carrier elements do not hinder the nesting of adjacent lap creels, for example, for storage or transportation.

FIG. 3 also shows the side view of the modified carrier element 11. The radially inwardly extending cut-out 12 is located adjacent the larger diameter end of the creel. Both types of carrier elements 1 and 11 have a substantially right-angle triangular side view shape whereby the hypotenuse forming edge extends radially outwardly. Due to this shape the cage formed by the carrier elements 1 or 11 has a radially outer conical configuration and a radially inner cylindrical configuration.

Although the invention has been described with reference to specific example embodiments, it will be appreciated, that it is intended, to cover all modifications and equivalents within the scope of the appended claims.

What is claimed is:

1. A lap creel comprising rod shaped carrier elements (1) each having a cross-section with a long axis of given length and a short axis of a length less than said given length of said long axis, and holding means (2, 3, 4, 5) for said carrier elements (2) to form with said carrier elements a cage having a longitudinal, central axis from which said long cross-section axes extend radially, said carrier elements (1) having a substantially right-angled triangular shape and radially outwardly facing longitudinal edges forming the hypotenuse of the respective triangle whereby these edges extend at an acute angle relative to said central axis of said cage whereby the latter has a conical outer configuration and a cylindrical inner configuration, said lap creel having one end of largest diameter and an opposite end of smallest diameter, said holding means comprising at least one first holding element (5) at said largest diameter end and at least one second holding element (2) at said smallest diameter end, said first and second holding elements (5, 2) being so positioned that said carrier elements extend radially inwardly at said largest diameter end in the area of the respective first holding element (5) and radially outwardly at said smallest diameter end in the area of the respective second holding element, whereby said lap creel is insertable coaxially into another lap creel of the same construction to a definite proportion of its height.

2. The lap creel of claim 1, wherein said first holding element (5) in the area of said largest diameter end forms the jacket of a frustum, said frustum jacket having a roughened outer surface (10), said lap creel further comprising a ring groove in said outer surface of said frustum whereby a thread reserve may be freely accessible when it is located on said outer surface (10).

3. The apparatus of claim 1, wherein said holding means comprise further holding elements in addition to said first and second holding elements, one such further holding element being located at about one third of the length of said carrier elements away from said smallest diameter end, said one further holding element having a larger outer diameter than any other holding element arranged along said one third length of said carrier elements.

4. The lap creel of claim 2, wherein said substantially right-angled triangular shapes of said carrier elements have step like cut-outs on their radially inwardly directed sides adjacent said largest diameter end and at least partially within said frustum jacket, whereby a free space is formed within the lap creel adjacent said largest diameter end, said free space having an inner diameter larger than the outer diameter of any holding element in the one third length of said lap creel adjacent to said smallest diameter end of the lap creel.

5. The lap creel of claim 1, wherein said rod shaped carrier elements have a conical cross-section which diminishes in a radially outward direction, said carrier elements further having rounded edges.

6. The lap creel of claim 1, wherein said hypotenuse forming longitudinal edges of said carrier elements are bow shaped in the area adjacent said smallest diameter end to thereby extend toward said central, longitudinal axis of said cage, whereby said triangular shape is truncated at said smallest diameter end.

* * * * *